US008023875B2

(12) United States Patent
Cahill et al.

(10) Patent No.: US 8,023,875 B2
(45) Date of Patent: Sep. 20, 2011

(54) SYSTEM AND DRIVE ARRANGEMENT FOR USING FUSER TEMPERATURE CYCLING TO CHANGE ROTATIONAL POSITION OF A FUSER ROLLER WIPER

(75) Inventors: Daniel Paul Cahill, Verona, KY (US); Thomas Paul Maddux, Lexington, KY (US); Chad Michael Piening, Lexington, KY (US); Louann Behymer Samuels, Georgetown, KY (US); Curtis Duane Woodson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 201 days.

(21) Appl. No.: 12/346,229

(22) Filed: Dec. 30, 2008

(65) Prior Publication Data

US 2010/0166469 A1 Jul. 1, 2010

(51) Int. Cl.
*G03G 15/20* (2006.01)

(52) U.S. Cl. ..... 399/327

(58) Field of Classification Search ..... 399/325, 399/326, 327; 219/216; 118/60
See application file for complete search history.

(56) References Cited

U.S. PATENT DOCUMENTS

| | | | | | |
|---|---|---|---|---|---|
| 4,549,803 | A * | 10/1985 | Ohno et al. | 399/45 |
| 4,557,588 | A * | 12/1985 | Tomosada | 399/352 |
| 6,875,164 | B1 | 4/2005 | Lebold et al. | |
| 6,950,615 | B2 * | 9/2005 | Jung et al. | 399/67 |
| 7,274,903 | B2 | 9/2007 | Carter et al. | |
| 7,299,001 | B2 * | 11/2007 | Yamazaki | 399/327 |

FOREIGN PATENT DOCUMENTS

| | | | |
|---|---|---|---|
| JP | 59030575 | A * | 2/1984 |
| JP | 02280182 | A * | 11/1990 |
| JP | 04014082 | A * | 1/1992 |
| JP | 11352816 | A * | 12/1999 |
| JP | 2000187410 | A * | 7/2000 |
| JP | 2002365955 | A * | 12/2002 |
| JP | 2003140504 | A * | 5/2003 |
| JP | 2003167466 | A * | 6/2003 |
| JP | 2008040279 | A * | 2/2008 |

* cited by examiner

*Primary Examiner* — Robert Beatty

(57) ABSTRACT

A system and drive arrangement for using fuser temperature cycling to change rotational position of a fuser roller wiper includes a frame, a hot roll, a fuser roller, and a drive arrangement. The frame of the fuser unit has side panels spaced apart from one another and positioned alongside a media path through the fuser unit. The hot roll on the fuser unit is rotatably mounted to the side panels of the frame and extends between the side panels across the media path. The fuser roller wiper is rotatably mounted between the side panels of the frame and performs a wiping action on the hot roll to remove foreign matter therefrom and supply of lubricant thereto. The drive arrangement is coupled to the fuser roller wiper and is operable in response to decrease in temperature of the fuser unit to rotate the fuser roller wiper.

20 Claims, 2 Drawing Sheets

SYSTEM AND DRIVE ARRANGEMENT FOR USING FUSER TEMPERATURE CYCLING TO CHANGE ROTATIONAL POSITION OF A FUSER ROLLER WIPER

BACKGROUND

1. Field of the Invention

The present invention relates generally to a fuser roller wiper and, more particularly, to a system and drive arrangement for using fuser temperature cycling to change rotational position of the fuser roller wiper.

2. Description of the Related Art

A fuser unit is a common part of a printer, copier, or other printing device that melts and adheres toner onto print media. The print media passes between components in the fuser unit where heat and pressure bond the toner to the print media. The fuser unit typically includes a hot roll and a backup roller that form a fuser nip. The fuser nip is where one roll touches another and print media pass between them through driving contact with them. The hot roll is typically driven, along with several in-feed and out-feed rolls, by a drive system of the fuser unit to transport the print media to and from the nip. The drive system typically includes a fuser motor mounted to a frame of the fuser unit and operatively connected to the hot roll and other rolls by a drive train which includes gears, belts and the like.

Heretofore, a replaceable wiper bar has been provided in the fuser unit above the hot roll to both clean and lubricate the hot roll and thereby to help extend the life of the fuser unit. Especially when a printer is running labels, the wiper bar is needed to wipe contaminants from the hot roll and to apply oil (or wax) to the hot roll to keep it lubricated to help protect it against top coats and adhesives used in label construction. Since only a limited amount of oil (or wax) can be loaded into the felt wiper bar, it is recommended that users change the wiper bar twice during the life of a fuser unit. Users often neglect to do this, shortening the useful life of the fuser unit.

The provision of a permanent or non-replaceable fuser roller wiper in place of the replaceable wiper bar has been proposed to provide an effective means to both clean and lubricate the hot roll throughout its useful life and thus obviate the problem created by users not following the recommendation for periodic replacement of the wiper bar. One such fuser roller wiper is described and illustrated in U.S. Pat. No. 6,875,164 to Lebhold et al. The Lebhold patent discusses the importance to meter a precise amount of release agent per revolution of the hot roll. One of the factors mentioned is the speed of the fuser roller wiper relative to the hot roll. However, this patent does not provide any guidance of how to rotate the fuser roller wiper.

Consequently, there is a need for an innovation that will provide an effective way to rotate the fuser roller wiper so that it will be effective in both cleaning and lubricating the hot roll of a fuser unit.

SUMMARY OF THE INVENTION

The present invention provides an innovation in the form of drive arrangement for periodically rotating a fuser roller wiper in a cost-effective manner relative to the hot roll. The drive arrangement thus makes the fuser roller wiper an effective means for cleaning and lubricating the hot roll. The drive arrangement avoids the likely conventional approaches to rotating the fuser roller wiper, such as providing an additional motor or by "siphoning off" some of the power used to operate other components, which would appear costly. Instead, the drive arrangement of the present invention makes use of energy in the form of waste heat generated by the fuser unit which does not adversely impact the performance of the fuser unit.

Accordingly, in an aspect of the present invention, a system for using fuser temperature cycling to change the rotational position of a fuser roller wiper relative to a fuser hot roll includes a frame of a fuser unit having opposite side portions spaced apart from one another and positioned alongside a media path through the fuser unit. The fuser unit during normal operation undergoes an increase and decrease in temperature. Also, the hot roll is rotatably mounted between the side portions and extends across the media path. The hot roll is operable to undergo rotation in one direction during a fusing operation performed on media moving in the media path through the fuser unit. Further, the fuser roller wiper is rotatably mounted between the side portions and extends generally parallel to the hot roll such that one lengthwise section of the fuser roller wiper makes contact with and performs a wiping action on the hot roll. Finally, a drive arrangement is coupled to the fuser roller wiper and is operable in response to a decrease in temperature of the fuser unit to cause rotation of the fuser roller wiper in an other direction opposite to the one direction of rotation of the hot roll at their location of contact in order to bring to bring another lengthwise section of the fuser roller wiper into contact with the hot roll.

In a further aspect of the present invention, a drive arrangement for using temperature cycling of a machine to change the rotational position of a rotatable member of the machine includes a one-way torque transmission mechanism drivingly connected to the rotatable member of the machine and rotatable in one and the other of opposite directions. The one-way torque transmission mechanism is capable of drivingly rotating the rotatable member in the one direction as the one-way torque transmission is itself rotated in the same one direction. The one-way torque transmission mechanism is also capable upon rotating in the other direction of preventing the rotatable member from rotating in the other direction.

Additionally, the drive arrangement includes an elongated member adapted to expand and contract in length in response to an increase and decrease in temperature of the elongated member due to corresponding temperature cycling of the machine in the vicinity of the elongated member. The elongated member is stationarily anchored at one end and extends therefrom in the vicinity of the machine to and about the one-way torque transmission mechanism in a driving relationship therewith such that movement of the elongated member toward and away from the one-way torque transmission mechanism due to expansion and contraction of the length of the elongated member causes the one-way torque transmission mechanism to rotate correspondingly in the one and other opposite directions.

Further, the drive arrangement includes a stretchable and retractable member stationarily anchored at one end and attached at an opposite end to the other end of the elongated member such that the stretchable and retractable member stretches in response to the contraction of the elongated member in length causing the one-way torque transmission mechanism to rotate in the one direction and rotate the rotatable member therewith. The stretchable and retractable member retracts in response to expansion of the elongated member in length causing the one-way torque transmission mechanism to rotate in the other direction and prevent rotation of the rotatable member therewith.

BRIEF DESCRIPTION OF THE DRAWINGS

Figure 1:
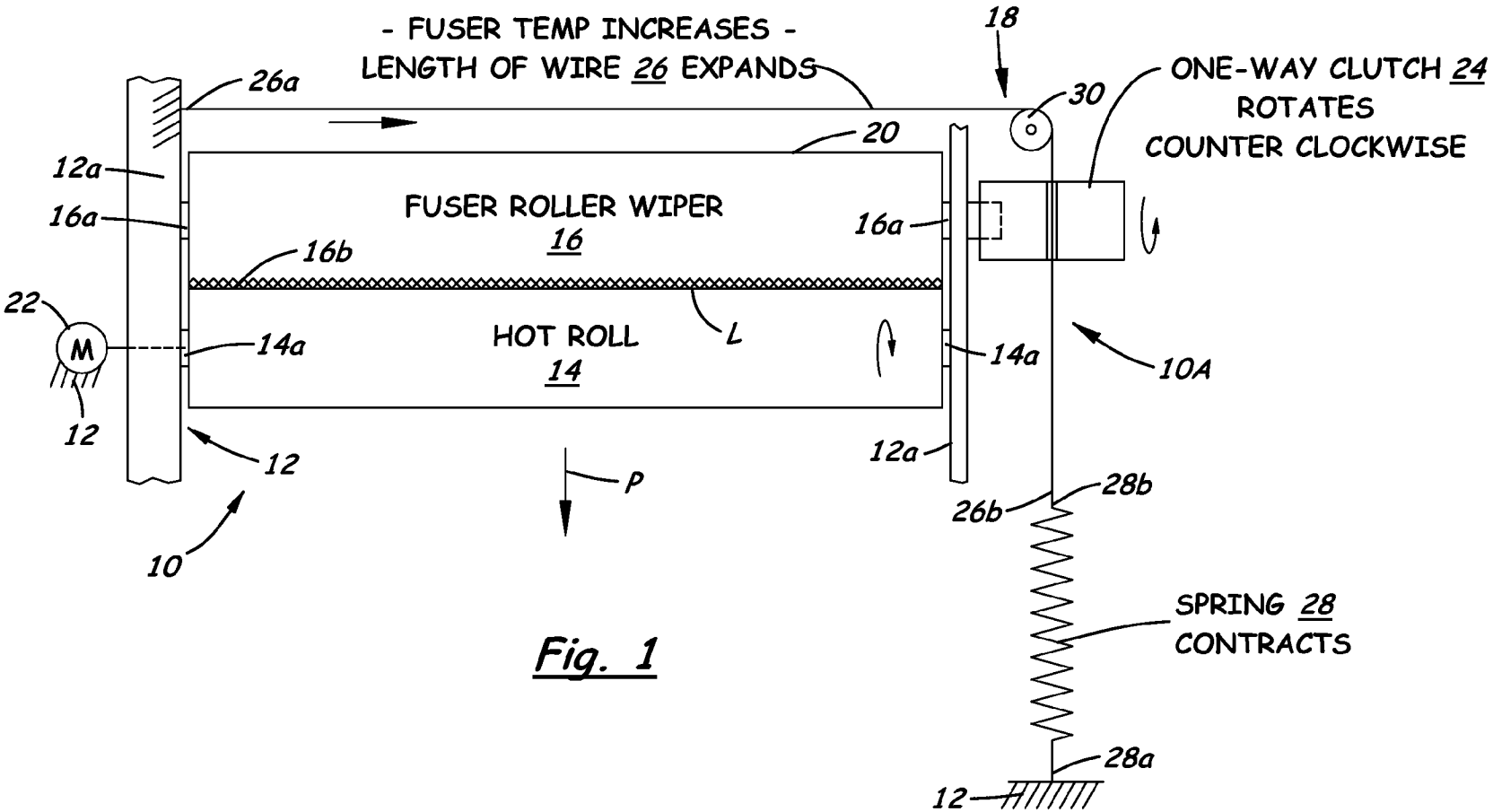

Having thus described the invention in general terms, reference will now be made to the accompanying drawings, which are not necessarily drawn to scale, and wherein:

FIG. 1 is a diagrammatic view of a hot roller and fuser roller wiper of a fuser unit with a drive arrangement of the present invention shown in conjunction with the fuser roller wiper during increase in the temperature of the fuser unit.

Figure 2:
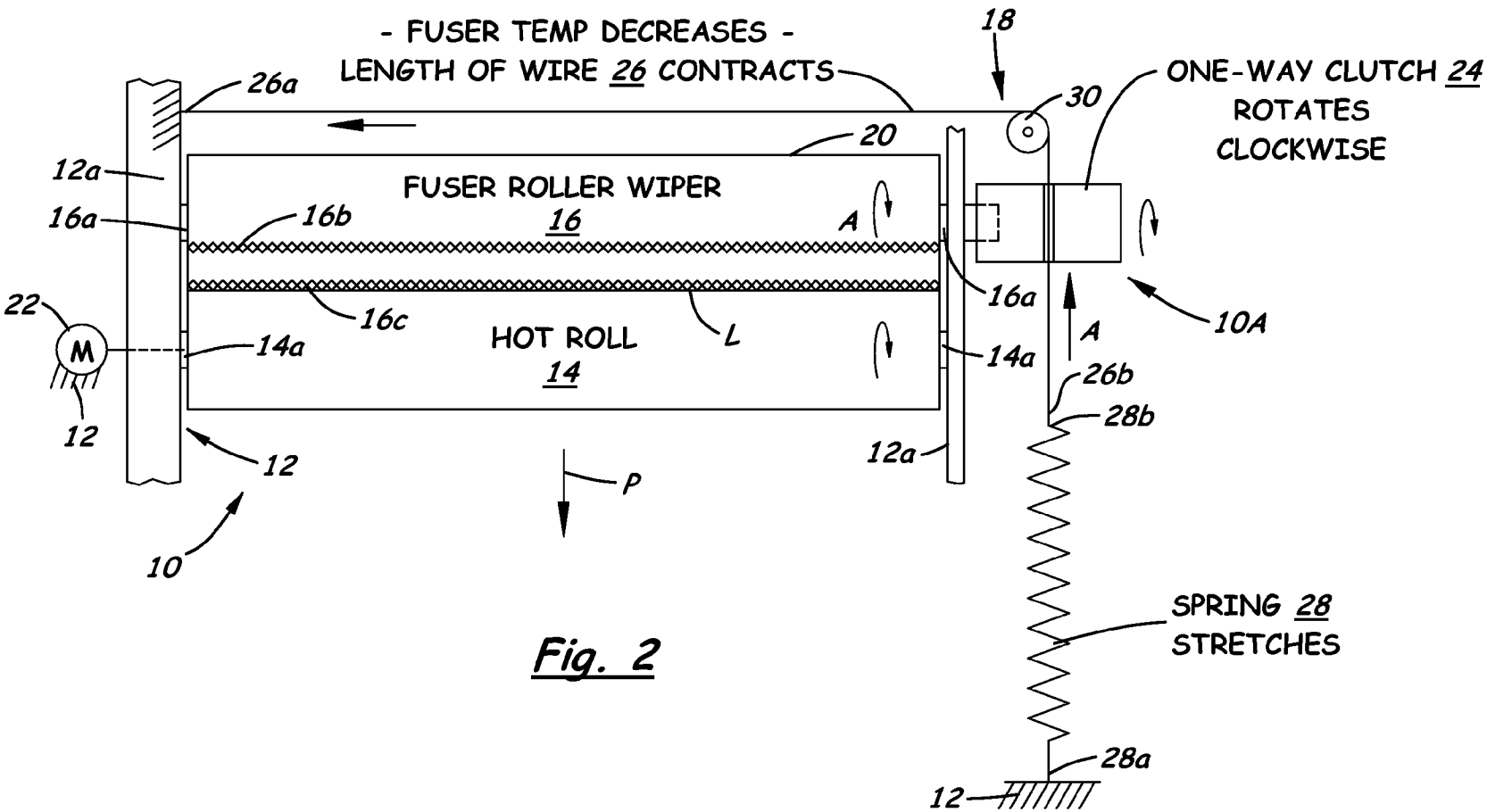

FIG. 2 is another diagrammatic view similar to FIG. 1 but now showing the drive arrangement in conjunction with the fuser roller wiper during decrease in the temperature of the fuser unit.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1 and 2, there is diagrammatically illustrated an exemplary embodiment of a portion of a fuser unit 10 of a printing machine that incorporates the system of the present invention, generally designated 10A. The system 10A basically includes a frame 12, a hot roll 14 rotatably mounted to the frame 12, a fuser roller wiper 16 also rotatably mounted to the frame 12, and a drive arrangement, generally designated 18, supported by the frame 12 and coupled to the fuser roller wiper 16. The frame 12 of the fuser unit 10 employed by the system 10A has opposite side portions such as in the form of side panels 12*a* or the like spaced apart from one another and positioned alongside a media path P through the fuser unit 10, as seen in FIGS. 1 and 2. The fuser unit 10 during normal operation undergoes an increase and decrease in temperature ranging from 20° C. to 260° C.

The hot roll 14 on the fuser unit 10 is rotatably mounted at its opposite ends 14*a* to the side panels 12*a* of the frame 12 and extends between the side panels 12*a* across the media path P. The hot roll 14 is operable to undergo rotation in a clockwise direction during a fusing operation performed on media moving in the media path P through the fuser unit 10. The hot roll 14 has a peripheral surface 20, generally cylindrical in configuration, which is adapted to contact the media in the media path P during the fusing operation, causing an increase in collection of foreign matter on the peripheral surface 20 of the hot roll 14 and a decrease in the amount of lubricant thereon. A motor 22 on the frame 12 of the fuser unit 10 is drivingly coupled to the hot roll 14 to rotate the hot roll 14 in the clockwise direction during the fusing operation, as seen in FIG. 1.

The fuser roller wiper 16 is advantageously provided to remove the foreign matter and supply lubricant to the hot roll 14. A representative example of a fuser roller wiper is disclosed in the above cited U.S. Pat. No. 6,875,164. As seen in FIG. 1, the fuser roller wiper 16 is rotatably mounted at opposite ends 16*a* to the side panels 12*a* of the frame 12 and extends between the side panels 12*a*, extending generally parallel to the hot roll 14 such that one lengthwise section 16*b* of the fuser roller wiper 16 makes contact with and performs a wiping action on the hot roll 14 to effect removal of the foreign matter therefrom and supply of lubricant thereto. However, periodically the fuser roller wiper 16 needs to be rotated, as seen in FIG. 2, at least an appropriate fraction of one revolution to ensure that another different lengthwise section 16*c* of the fuser roller wiper 16 is brought into contact with the hot roll 14 so as to avoid potential damage through drying out of any one of the lengthwise sections 16*b*, 16*c* of the surface 20 of the fuser roller wiper 16.

The drive arrangement 18 of the system 10A is advantageously provided to periodically drive rotation of the fuser roller wiper 16, without use of any motor-supplied power, only by using waste heat from cycling within the range of temperatures noted earlier that the fuser unit 10 undergoes during its normal operation. The drive arrangement 18 is coupled to the fuser roller wiper 16 and is operable in response to decrease in temperature of the fuser unit 10. This decrease in temperature of the fuser unit 10, via operation of the drive arrangement 18, causes rotation of the fuser roller wiper 16 in the clockwise direction, and thus opposite to the clockwise direction of rotation of the hot roll 14 at their lengthwise location L of contact with one another to bring another lengthwise section of the fuser roller wiper 16 into contact with the hot roll 14. The drive arrangement 18 thus makes the fuser roller wiper 16 an effective means for cleaning and lubricating the hot roll 14 by the performance of the wiping action at different lengthwise locations L of contact between them due to the periodic opposite direction rotation of the fuser roller wiper 16 relative to the hot roll 14.

The drive arrangement 18 avoids the usual conventional approaches that could be employed for rotating the fuser roller wiper 16, such as by providing an additional costly motor or by "siphoning off" some of the power used to operate other components that may have an adverse impact on their operation. Instead, the drive arrangement 18 of the system 10A of the present invention makes use of energy in the form of waste heat generated by the fuser unit 10 which does not adversely impact the performance of the fuser unit 10.

Thus, in view of the foregoing, the drive arrangement uses the temperature cycling of a machine, in this instance the fuser unit 10, to change the rotational position of a rotatable member, in this instance the fuser roller wiper 16 of the fuser unit 10, relative to the hot roll 14 of the fuser unit 10. The drive arrangement 10 basically includes a one-way torque transmission mechanism, an elongated member, and a stretchable and retractable member. By way of example and not limitation, the one-way torque transmission mechanism may be in the form of a one-way clutch 24. Also, by way of example and not limitation, the elongated member may be a heat sensitive strand of wire 26. Further, by way of example and not limitation, the stretchable and retractable member may be a spring and more particularly a coil spring 28.

The one-way clutch 24 is drivingly connected to one end 16*a* of the fuser roller wiper 16 of the fuser unit 10 and is rotatable in one and the other of opposite directions, in other words, clockwise or counterclockwise directions. The one-way clutch 24 is capable of drivingly rotating the fuser roller wiper 12 in the clockwise direction as the one-way clutch 24 is itself rotated in the same direction. The one-way clutch 24 is also capable, upon rotating in the counterclockwise direction, of preventing the fuser roller wiper 16 from rotating in the same direction. As one suitable example, the one-way clutch 24 may be implemented by use of a commercially-available one-way clutch marketed by Origin designated as OWG-GX or -GXZ Type in Cat. No. 136.

The temperature-sensitive strand of wire 26 can be manufactured from either stainless steel, a suitable plastic material, such as FEP, or any other suitable material. The strand of wire 26 is adapted to expand and contract in length in response to increase and decrease in its temperature due to corresponding temperature cycling of the fuser unit 10 in the vicinity of the strand of wire 26. The strand of wire 26 is stationarily anchored at one end 26*a*, such as to the side panel 12*a* of the frame 12, and extends therefrom in the vicinity of the fuser unit 10 to and about an idler pulley 30 and therefrom to the one-way clutch 24. The strand of wire 26 is wrapped several times about the one-way clutch 24 so as to be in a driving relationship with the one-way clutch 24. Then, movement of the strand of wire 26 toward and away from the one-way clutch 24 due to expansion and contraction of the length of the strand of wire 26 causes the one-way clutch 24 to rotate correspondingly in the one and the other opposite clockwise and counterclockwise directions.

The coil spring 28 is stationarily anchored at one end 28*a*, such as to a suitable location on the frame 12 of the fuser unit 10, and attached at an opposite end 28*b* to the other end 26*b* of the strand of wire 26. In such arrangement, as seen in FIG. 2, the coil spring 28 stretches in response to contraction of the strand of wire 26 in length causing the one-way clutch 24 to rotate in the clockwise direction and rotate the fuser roller wiper 16 therewith. The coil spring 28 retracts in response to the expansion of the strand of wire 26 in length causing the one-way clutch 24 to rotate in the counterclockwise direction while preventing rotation of the fuser roller wiper 14 therewith. The rotation of the fuser roller wiper 14 by the contraction of the strand of wire 26 only need be of short duration and distance, just enough to change one to another of the lengthwise sections 16*b*, 16*c* of the fuser roller wiper 14 that contacts the hot roll 14.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for using fuser temperature cycling to change the rotational position of a fuser roller wiper relative to a fuser hot roll, comprising:

a frame of a fuser unit having opposite side portions spaced apart from one another and positioned alongside a media path through the fuser unit, the fuser unit during normal operation undergoing increase and decrease in temperature;

a hot roll rotatably mounted between the side portions and extending across the media path, the hot roll operable to undergo rotation in one direction during a fusing operation performed on media moving in the media path through the fuser unit, a fuser roller wiper rotatably mounted between the side portions and extending generally parallel to the hot roll such that one lengthwise section of the fuser roller wiper makes contact with and performs a wiping action on the hot roll; and a drive arrangement coupled to the fuser roller wiper and operable in response to decrease in temperature of the fuser unit to cause rotation of the fuser roller wiper in an other direction opposite to the one direction of rotation of the hot roll at their location of contact in order to bring another lengthwise section of the fuser roller wiper into contact with the hot roll;

wherein said drive arrangement includes a one-way torque transmission mechanism drivingly connected to the fuser roller wiper of a fuser unit and being rotatable in the one and the other of opposite directions, the one-way torque transmission mechanism is capable of drivingly rotating the fuser roller wiper in the other direction as the one-way torque transmission mechanism is itself rotated in the same direction, the one-way torque transmission is also capable upon rotating in the one direction of preventing the fuser roller wiper from rotating in the one direction; and wherein said drive arrangement also includes an elongated member adapted to expand and contract in length in response to an increase and decrease in temperature of the elongated member due to corresponding temperature cycling of the fuser unit in the vicinity of the elongated member, the elongated member stationarily anchored at one end and extending therefrom in the vicinity of the fuser unit to and about the one-way torque transmission mechanism in a driving relationship therewith such that movement of the elongated member toward and away from the one-way torque transmission mechanism due to expansion and contraction of the length of the elongated member causes the one-way torque transmission mechanism to rotate correspondingly in the one and the other opposite directions.

2. The system of claim 1 wherein the one-way torque transmission mechanism is a one-way clutch.

3. The system of claim 1 wherein the elongated member is an elongated strand of wire.

4. The system of claim 3 wherein the elongated strand of wire is a strand of stainless steel wire.

5. The system of claim 3 wherein the elongated strand of wire is a strand of plastic material.

6. The system of claim 1 wherein said drive arrangement further includes a stretchable and retractable member stationarily anchored at one end and attached at an opposite end to the other end of the elongated member such that the stretchable and retractable member stretches in response to contraction of the elongated member in length causing the one-way torque transmission mechanism to rotate in the other direction and rotate the fuser roller wiper therewith and the stretchable and retractable member retracts in response to expansion of the elongated member in length causing the one-way clutch to rotate in the one direction and prevent rotation of the fuser roller wiper therewith.

7. The system of claim 6 wherein the stretchable and retractable member is a spring.

8. The system of claim 7 wherein the spring is a coil spring.

9. The system of claim 1, wherein the drive arrangement is a passive drive arrangement, without processor control.

10. A drive arrangement for using temperature cycling of a machine to change the rotational position of a rotatable member of the machine, comprising:

a one-way torque transmission mechanism drivingly connected to a rotatable member of a machine and being rotatable in one and the other of opposite directions, the one-way torque transmission mechanism capable of drivingly rotating the rotatable member in the one direction as the one-way torque transmission is itself rotated in the same one direction, the one-way torque transmission mechanism also capable upon rotating in the other direction of preventing the rotatable member from rotating in the other direction;

an elongated member adapted to expand and contract in length in response to an increase and decrease in temperature of the elongated member due to corresponding temperature cycling of the machine in the vicinity of the elongated member, the elongated member stationarily anchored at one end and extending therefrom in the vicinity of the machine to and about the one-way torque transmission mechanism in a driving relationship therewith such that movement of the elongated member toward and away from the one-way torque transmission mechanism due to expansion and contraction of the length of the elongated member causes the one-way torque transmission mechanism to rotate correspondingly in the one and other opposite directions; and a stretchable and retractable member stationarily anchored at one end and attached at an opposite end to the other end of the elongated member such that the stretchable and retractable member stretches in response to the contraction of the elongated member in length causing the one-way torque transmission mechanism to rotate in the one direction and rotate the rotatable member therewith and the stretchable and retractable member retracts in response to expansion of the elongated member in length causing the one-way torque transmission mechanism to rotate in the other direction and prevent rotation of the rotatable member therewith.

11. The system of claim 10 wherein the one-way torque transmission mechanism is a one-way clutch.

12. The system of claim 10 wherein the elongated member is an elongated strand of wire.

13. The system of claim 10 wherein the stretchable and retractable member is a spring.

14. The system of claim 10 wherein the spring is a coil spring.

15. A drive arrangement for using temperature cycling of a fuser unit to change the rotational position of a fuser roller wiper of the fuser unit, comprising:

a one-way torque transmission mechanism drivingly connected to a fuser roller wiper of a fuser unit and being rotatable in one and the other of opposite directions, the one-way torque transmission mechanism capable of drivingly rotating the fuser roller wiper in the one direction as the one-way torque transmission mechanism is itself rotated in the same one direction, the one-way torque transmission also capable upon rotating in the other direction of preventing the fuser roller wiper from rotating in the other direction;

an elongated member adapted to expand and contract in length in response to increase and decrease in temperature of the elongated member due to corresponding temperature cycling of the fuser unit in the vicinity of the elongated member, the elongated member stationarily anchored at one end and extending therefrom in the vicinity of the fuser unit to and about the one-way torque transmission mechanism in a driving relationship therewith such that movement of the elongated member toward and away from the one-way torque transmission mechanism due to expansion and contraction of the length of the elongated member causes the one-way torque transmission mechanism to rotate correspondingly in the one and the other opposite directions; and a stretchable and retractable member stationarily anchored at one end and attached at an opposite end to the other end of the elongated member such that the stretchable and retractable member stretches in response to contraction of the elongated member in length causing the one-way torque transmission mechanism to rotate in the one direction and rotate the fuser roller wiper therewith and the stretchable and retractable member retracts in response to expansion of the elongated member in length causing the one-way torque transmission mechanism to rotate in the other direction and prevent rotation of the fuser roller wiper therewith.

16. The system of claim 15 wherein the one-way torque transmission mechanism is a one-way clutch.

17. The system of claim 15 wherein the elongated member is an elongated strand of wire.

18. The system of claim 17 wherein the strand of wire is one of a strand of stainless steel wire or a strand of plastic material.

19. The system of claim 15 wherein the stretchable and retractable member is a spring.

20. A system for using fuser temperature cycling to change the rotational position of a fuser roller wiper relative to a fuser hot roll, comprising:

a frame of a fuser unit having opposite side portions spaced apart from one another and positioned alongside a media path through the fuser unit, the fuser unit during normal operation undergoing increase and decrease in temperature;

a hot roll rotatably mounted between the side portions and extending across the media path, the hot roll operable to undergo rotation in one direction during a fusing operation performed on media moving in the media path through the fuser unit, a fuser roller wiper rotatably mounted between the side portions and extending generally parallel to the hot roll such that one lengthwise section of the fuser roller wiper makes contact with and performs a wiping action on the hot roll; and a drive arrangement coupled to the fuser roller wiper and operable in response to decrease in temperature of the fuser unit to cause rotation of the fuser roller wiper in an other direction opposite to the one direction of rotation of the hot roll at their location of contact in order to bring another lengthwise section of the fuser roller wiper into contact with the hot roll;

wherein the drive arrangement is a passive drive arrangement, without processor control.

* * * * *